US007987983B1

(12) United States Patent
Guitreau

(10) Patent No.: US 7,987,983 B1
(45) Date of Patent: Aug. 2, 2011

(54) TUBULAR CONTAINER

(76) Inventor: Norman L. Guitreau, White Hall, AR (US)

( * ) Notice: Subject to any disclaimer, the term of this patent is extended or adjusted under 35 U.S.C. 154(b) by 285 days.

(21) Appl. No.: 12/287,435

(22) Filed: Oct. 9, 2008

Related U.S. Application Data

(60) Provisional application No. 60/997,961, filed on Oct. 9, 2007.

(51) Int. Cl.
*B65D 85/20* (2006.01)

(52) U.S. Cl. ..... 206/443; 206/806; 211/60.1; 211/74

(58) Field of Classification Search ..... 206/443, 206/446, 373, 806; 211/60.1, 69, 74; 312/72, 312/73, 206, 207
See application file for complete search history.

(56) References Cited

U.S. PATENT DOCUMENTS

| | | | | | |
|---|---|---|---|---|---|
| 3,175,695 | A | * | 3/1965 | Goodman et al. | 211/74 |
| 3,379,315 | A | * | 4/1968 | Broadwin | 211/72 |
| 3,612,336 | A | * | 10/1971 | Wilkich | 220/516 |
| 3,774,774 | A | * | 11/1973 | Menkel | 211/72 |
| 3,986,695 | A | * | 10/1976 | Hronas | 248/222.51 |
| 4,720,021 | A | * | 1/1988 | Byrns | 220/764 |
| 4,850,484 | A | * | 7/1989 | Denman | 206/366 |
| 4,989,734 | A | * | 2/1991 | Mode et al. | 206/575 |
| 5,148,919 | A | * | 9/1992 | Rubin | 206/443 |
| 5,460,280 | A | | 10/1995 | Feddeler | |
| 5,533,618 | A | * | 7/1996 | Pickels, Jr. | 206/363 |
| 5,850,917 | A | * | 12/1998 | Denton et al. | 206/366 |
| 6,095,344 | A | | 8/2000 | White | |
| 6,311,626 | B1 | | 11/2001 | Roberts | |
| 6,354,682 | B1 | | 3/2002 | Nott et al. | |
| 6,357,842 | B1 | | 3/2002 | Nott et al. | |
| 6,401,931 | B1 | * | 6/2002 | Javell et al. | 206/775 |
| 6,550,878 | B2 | | 4/2003 | Nott et al. | |
| 6,725,608 | B1 | | 4/2004 | Kraus | |
| 7,234,601 | B2 | * | 6/2007 | Aspden | 211/10 |
| 2003/0015446 | A1 | * | 1/2003 | Talbot | 206/373 |
| 2006/0243622 | A1 | * | 11/2006 | Lyman, Jr. | 206/443 |

* cited by examiner

*Primary Examiner* — David T Fidei
(74) *Attorney, Agent, or Firm* — Montgomery Patent and Design; Robert C. Montgomery

(57) ABSTRACT

An apparatus to store tubular storage containers is herein disclosed. Each tube has a closed end and an open end provided with a threaded cap that can be easily removed by hand. The tubes are ideal for storing long, thin objects, but can also be used to store small objects such as nails, screws, fasteners and the like. To aid in the storage of the tubes themselves, a wall-mounted enclosure is provided preferably providing twelve (12) tubes; however, the size of the enclosure and number of tubes may vary depending on the application. The apparatus is provided with a wall mounting plate allowing easy hanging and removal and may also be set upon a workbench or carried using an integral handle as well. The tubes are simply slid in and out of the enclosure for easy access.

18 Claims, 6 Drawing Sheets

TUBULAR CONTAINER

RELATED APPLICATIONS

The present invention was first described in and claims the benefit of U.S. Provisional Application No. 60/997,961 filed Oct. 9, 2007, the entire disclosures of which are incorporated herein by reference.

FIELD OF THE INVENTION

The present invention relates generally to a multiple tubular container device for mounting thereto a surface and capable of storing a plurality of elongated tubular containers slidingly placed therein corresponding receivers, further comprising a mounting means, a first fixture and a second fixture removably mounted thereto said device, and a handle.

BACKGROUND OF THE INVENTION

Garage areas, shops, machine shops and the like, have special storage and organization needs. Due to the large open area, people tend to place small objects in any size container that will fit from small old baby food jars, to large dilapidated old boxes. These temporary storage containers are the placed on the ground, clutter workbenches, or balance precariously on overcrowded shelves. Such organization quickly becomes not only cluttered looking but makes it extremely difficult to find the desired object. Accordingly, there exists a need for a means by which small and odd sized objects can be kept neat and organized in shops and garages without the disadvantages as described above. The development of the invention described herein fulfills this need.

When people move, they frequently disassemble beds, cabinets and other articles of furniture. There are various types of fasteners that are used to assemble these articles. Many of which are rather specialized and hard to replace if lost. Many people will utilize a zippered plastic bag to contain these fasteners. Unfortunately, this is not a viable option as during the course of a move, these bags are frequently torn and the contents subsequently lost. A tubular container enclosure with the ability to be marked as to the contents would fulfill the need for organization during a move and eliminate the problem discussed above.

There have been attempts in the past to provide storage solutions for garages, work shops and the like. U.S. Pat. No. 6,725,608 issued to Kraus discloses an overhead garage storage assembly that appears to comprise a storage space that is below a garage ceiling. Unfortunately, this patent does not appear to disclose a tube container comprising an enclosure capable of holding a plurality of tubular containers that are useful for storing and organizing varied small articles.

U.S. Pat. Nos. 6,550,878, 6,357,878 and 6,354,682 issued to Nott et al disclose overhead storage devices that appear to comprise pivotably mounted storage containers that are mounted to overhead building structural members, such as a ceiling. Unfortunately, these patents do not appear to disclose a tube container comprising an enclosure that holds a plurality of tubular containers and that is portable.

U.S. Pat. No. 6,311,626 issued to Roberts discloses a hanging storage shelf system that appears to comprise a plurality of rods for supporting a shelf from a ceiling. Unfortunately, this patent does not appear to disclose a tube container comprising an enclosure capable of holding a plurality of tubular containers that are useful for storing and organizing varied small articles.

U.S. Pat. No. 6,095,344 issued to White discloses an overhead storage system that appears to comprise a means for storing items such as a bicycle utilizing a counter-balancing weight system. Unfortunately, this patent does not appear to disclose a portable enclosure comprising a plurality of tubular containers that may be used to store small articles therein and that is capable of being wall mounted.

U.S. Pat. No. 5,460,280 issued to Feddeler discloses a suspended storage assembly that appears to comprise a storage basket that is pivotably mounted to an overhead structural member. Unfortunately, this patent does not appear to disclose a tube container comprising an enclosure capable of holding a plurality of tubular containers that are useful for storing and organizing varied small articles.

SUMMARY OF THE INVENTION

In light of the disadvantages as previously discussed in the prior art; it is apparent that there is a need for a tubular container which provides a means of storing multiple tubular containers.

It is an object of the tubular container to provide a durable and lightweight rack system constructed of molded opaque plastic panels.

It is a further object of the tubular container to provide an enclosure with a plurality of enclosures contained therein for receiving a plurality of tubular containers.

It is another object of the tubular container to provide a tubular container that is permanently sealed on one (1) end and that has a threaded cap that can be easily removed by hand on the other end.

Still a further object of the tubular container are transparent plastic cylindrical tubular containers that are ideal for storing long, thin objects, but can also be used to store small objects such as fasteners, craft supplies, fishing accessories, and the like.

Another object of the tubular container comprises receptacles that may be provided in a variety of lengths ranging from approximately eight (8) to sixteen (16) inches long dependent upon the different types of items being stored.

Still another object of the tubular container comprises containers that are simply slid in and out of enclosure.

Still a further object of the tubular container comprises tubular containers made of a transparent plastic material to aid in viewing contents.

Yet another object of the tubular container are a mounting plate and wall hanging fasteners made of rugged plated steel components.

Yet a further object of the tubular container is a wall-mountable plate system that enables quick installation and removal from a wall surface.

Yet another object of the tubular container is that it is portable and may be placed upon a workbench or may be transported using a carrying handle.

Still yet another object of the tubular container comprises preferably of twelve (12) receptacles; however, the size of the enclosure and number of receptacles may vary depending upon specific applications.

An aspect of the tubular container comprises an enclosure, a plurality of receptacles, a plurality of tubular containers, a plurality of labels, and a plurality of lids.

Another aspect of the tubular container comprises an enclosure comprising a handle, a front panel, a rear panel, a top panel, a pair of side panels. The enclosure further comprises four (4) wall hanging features, a pair of fixture hanging features, and a second fixture.

A further aspect of the tubular container comprises receptacles that are located internally to the enclosure and affixed to the front panel extending and attaching to an inner surface of the rear panel portion forming a closed end portion of said receptacle. The receptacle comprises a downward angle from a horizontal plane to provide convenient loading and unloading of the tubular containers. Each receptacle further comprises a receptacle key feature along a top surface and extending an entire length that provides an orientation means to an inserted tubular container.

Still another aspect of the tubular container comprises cylindrical tubular containers each comprising a tube body, a tube key portion, a tube lid, a male thread region, and a female threaded region. The tube body comprises a clear tubular form further comprising a distal end permanently sealed by a circular end portion and a proximal end. Adjacent to the end portion is the tube key portion which provides an orientation means to an inserted tubular container.

Still another a further aspect of the tubular container comprises provides a molded male thread region around a perimeter edge providing a secure threaded attachment thereto the screw-on tube lid.

Still yet another aspect of the tubular container comprises a tube lid made of a transparent plastic material and comprising a common cylindrical lid having an internal female threaded region.

Another aspect of the tubular container comprises an enclosure further comprising a first fixture and a second fixture that are removably attached respectively to the side panel portions. The first fixture comprises an open-ended plastic or metal "U"-shaped form suitable for vertical insertion of a pair of scissors or similar item providing added convenience to a user. The second fixture further comprising a four-sided box-like enclosure that provides convenient containment of miscellaneous items such as tape, writing devices, and the like.

Still a further aspect of the tubular container comprises side panels that provide an attachment means to said first and second fixtures via pairs of fixture hanging features and corresponding fixture hanging fasteners.

Yet another aspect of the tubular container comprises a plurality of user applied adhesive backed paper or plastic labels that provide identification means to included stored items. Said labels may be applied to either the front panel portion of the enclosure or upon the lids for quick identification of contents.

Still another aspect of the tubular container comprises a rear panel further comprising inverted keyhole-shaped wall hanging features located adjacent to each corner portion of said rear panel for mounting of the apparatus securely to a wall surface via a wall mounting plate.

Another aspect of the tubular container comprises first and second fixtures each comprising a pair integral fixture hanging fasteners along outer edges comprising circular appendages suitable for insertion into said fixture hanging features to secure said first and second fixtures.

Yet another aspect of the tubular container comprises a mounting plate comprising a rectangular-shaped plate approximately one-quarter (¼) inch thick and having a perimeter shape similar to that of the rear panel. The mounting plate provides quick installation and removal of said apparatus to a vertical wall surface.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
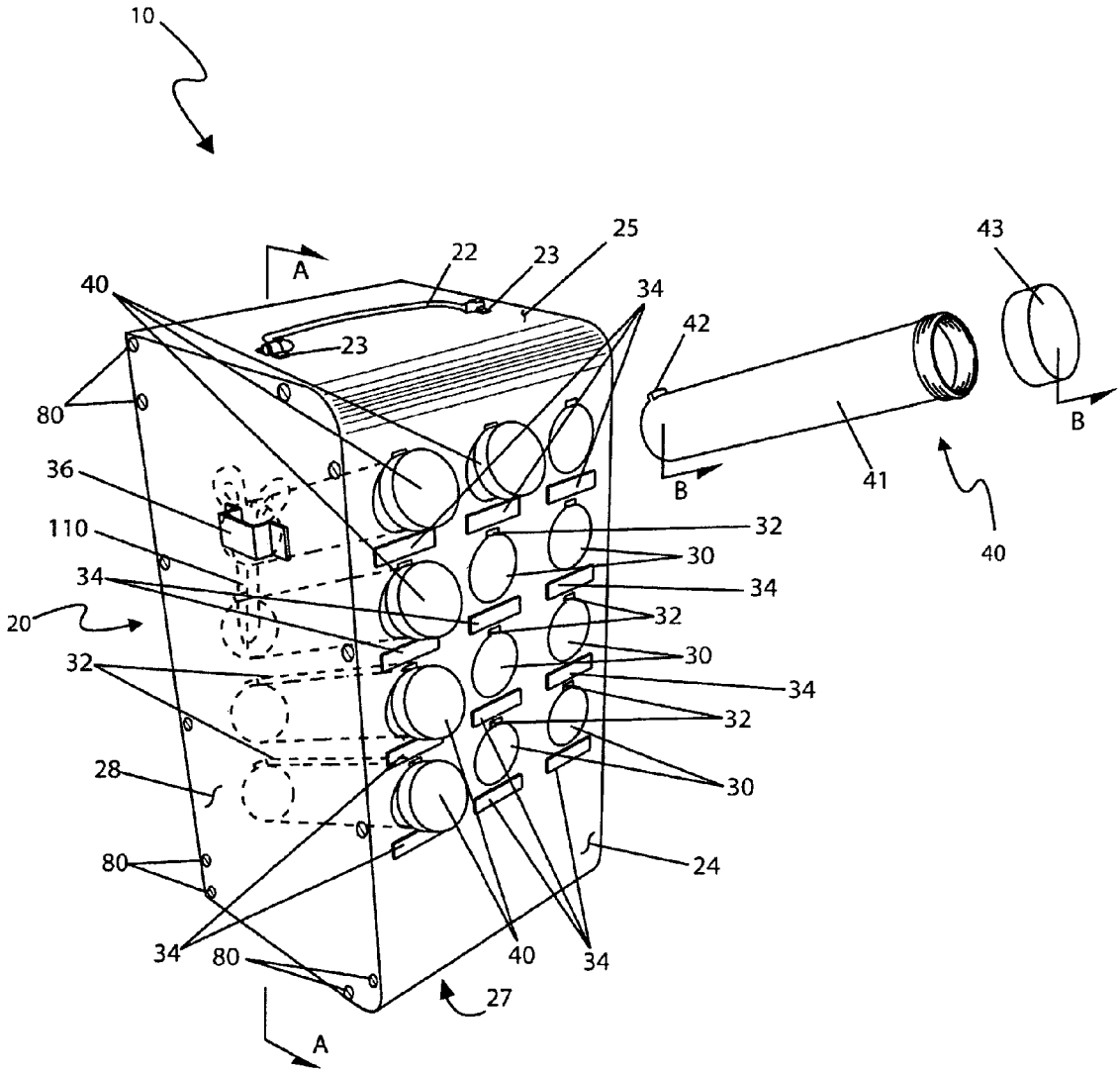
FIG. 1 is a front perspective view of a tube container 10, according to a preferred embodiment of the present invention.

10 tube container
20 enclosure
22 handle
23 handle fastener
24 front panel top panel
26 rear panel
27 bottom panel
28 side panel
29 wall hanging feature receptacle
32 receptacle key
34 label
35 fixture hanging feature
36 first fixture
37 second fixture
38 fixture hanging fastener
40 tubular container
41 tube body
42 tube key portion
43 tube lid
44 male threaded region
46 female threaded region
47 tube end portion
50 mounting plate
52 wall hanging fastener
80 fastener
100 wall surface
110 scissor

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method for a tube container (herein described as the "apparatus") 10, which provides a means of storing multiple tubular containers 40. One end of each container 40 is permanently sealed while the opposite end is provided with a threaded cap 43 that can be easily removed by hand. The containers 40 are ideal for storing long, thin objects, but can also be used to store small objects such as fasteners, craft supplies, fishing accessories, and the like. The containers 40 are slidingly engaged therein a receptacle 30 along a front panel 24 for easy access. A wall-mountable plate 50 system is provided to enable quick installation and removal therefrom a wall surface 100. Additionally, the apparatus 10 may be placed upon a workbench or may be transported using a carrying handle 22.

Referring now to FIG. 1, a front perspective view of the apparatus 10, according to the preferred embodiment of the present invention, is disclosed. The apparatus 10 comprises an enclosure 20, a plurality of receptacles 30, a plurality of tubular containers 40, a plurality of labels 34, and a plurality of lids 43. The enclosure 20 is envisioned to provide a durable and lightweight rack system constructed preferably using an assembly of molded opaque plastic panels approximately one-eighth (⅛) inch thick and assembled using a plurality of common fasteners 80 such as screws, rivets, or the like. The enclosure 20 comprises a rectangular structure approximately two (2) feet tall, one (1) foot deep, and one (1) foot wide. The enclosure 20 further comprises a frame further comprising a front panel 24, a top panel 25, and a bottom panel 27, a rear panel 26 attached to the frame, and a pair of side panels 28 each attached thereto the frame with said plurality of common fasteners 80. The fasteners 80 are preferably countersunk so as to eliminate any snagging or interference with other features of the apparatus. Alternately, the enclosure 20 may comprise a unitary molded construction. The receptacles 30 are located internally thereto the enclosure 20 being affixed thereto the front panel 24 and rear panel portions 26 of the enclosure 20. An open-ended portion of said receptacle 30 is affixed thereto the front panel portion 24 extending and attaching thereto an inner surface of the rear panel portion 26 forming a closed end portion of said receptacle 30. The receptacle 30 comprises a downward angle between thirty degrees) (30°) and forty-five degrees (45°) from a horizontal plane to provide convenient loading and unloading of the tubular containers 40. The apparatus 10 preferably comprises preferably of twelve (12) receptacles 30; however, the size of the enclosure 20 and number of receptacles 30 may vary depending upon specific applications. The receptacles 30 are envisioned to be affixed thereto said front 24 and rear 26 panels using common plastic joining processes such as plastic welding, adhesives, or the like. Each receptacle 30 further comprises a receptacle key feature 32 along a top surface thereof and extending an entire length thereof. The receptacle key 32 provides an orientation means thereto the tubular container 40 when inserted therein. The tubular containers 40 comprise a cylindrical vessel having a diameter of approximately two (2) to three (3) inches providing a smooth sliding-fit into the corresponding receptacles 30. Each tubular container 40 further comprises a tube key feature 42 providing an orientation means thereto the tubular container 40. In use, the tube key feature 42 in inserted thereinto the corresponding receptacle key feature 32 therein the receptacle 30. The tubular containers 40 are envisioned to be made of a transparent plastic material to aid in viewing contents therewithin (see FIG. 4). The enclosure 20 further comprises a first fixture 36 and a second fixture 37 (see FIG. 2) being removably attached respectively thereto the side panel portions 28. The first fixture 36 comprises an open-ended plastic or metal "U"-shaped form suitable for vertical insertion of a pair of scissors 110 or similar item therethrough, thereby providing added convenience to a user. The side panels 28 provide an attachment means thereto said first 36 and second 37 fixtures via pairs of fixture hanging features 35 and corresponding fixture hanging fasteners 38 (see FIG. 2). The apparatus 10 also comprises a plurality of user applied adhesive backed paper or plastic labels 34 providing an identification means thereto included stored items. Said labels 34 may be applied thereto either the front panel portion 24 of the enclosure 20 or thereupon the lids 43 for quick identification of contents within each tubular container 40.

Figure 2:
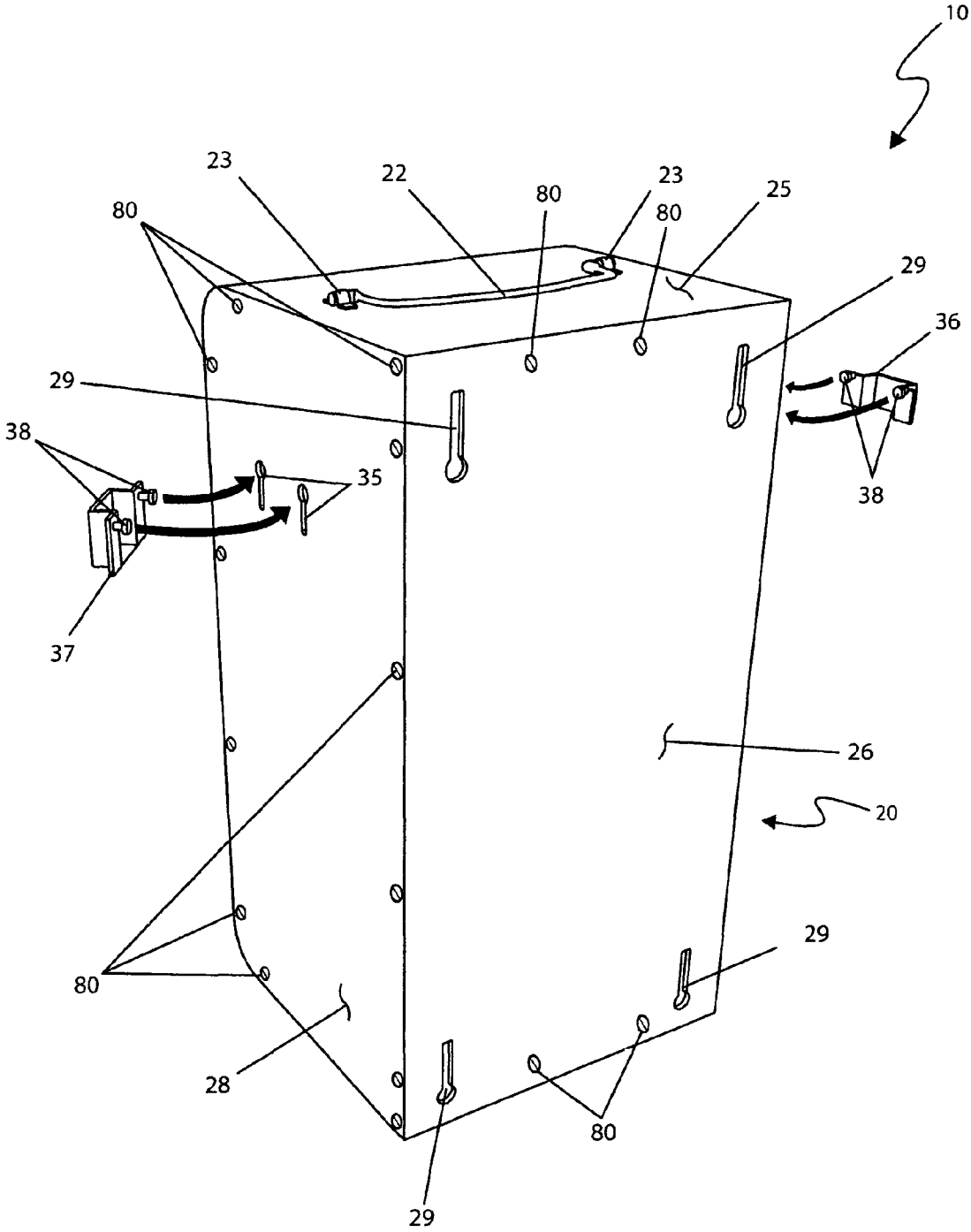
FIG. 2 is a rear perspective view of a tube container 10, according to a preferred embodiment of the present invention.

Referring now to FIG. 2, a rear perspective view of the apparatus 10, according to the preferred embodiment of the present invention, is disclosed. The apparatus 10 comprises a handle 22, a rear panel 26, four (4) wall hanging features 29, a pair of fixture hanging features 35, and a second fixture 37. The handle 22 provides portability thereto the apparatus 10 and comprises a common "U"-shaped pivoting fixture along the top panel 25. The handle 22 is securely affixed thereto said top surface via a pair of handle fasteners 23 providing an attachment means thereto said top panel 25 preferably using a plastic welding process of other strong fastening means such as screws, adhesives, or the like. The handle fasteners 23 also comprise an integral female aperture feature suitable to receive opposing end portions of said handle 22, thereby allowing a pivoting motion of the handle 22 thereto a normal vertical carrying position and a flat stored position. The rear panel 26 comprises inverted keyhole-shaped wall hanging features 29 located adjacent thereto each corner portion of said rear panel 26 for mounting of the apparatus 10 securely thereto a wall surface 100 via a wall mounting plate 50 (see FIG. 3). Said wall hanging features 29 provide a sliding and locking shape so as to receive a button-shaped wall hanging fastener 52 therethrough a lower larger opening portion of said wall hanging feature 29 and allowing the apparatus 10 to slide downwardly thereupon said fastener 52. The enclosure 20 further provides a removable attachment means thereto the aforementioned first fixture 36 and the second fixture 37 via pairs of fixture hanging features 35 along opposing side panels 28. The fixture hanging features 35 comprise female keyhole-shaped openings similar in construction and function as the aforementioned wall hanging features 29. The first 26 and second 27 fixtures each comprise a pair of integral fixture hanging fasteners 38 along outer edges comprising circular appendages suitable for insertion thereinto said fixture hanging features 35 to secure said first 36 and second 37 fixtures thereto. The second fixture 37 comprises a four-sided box-like enclosure providing convenient containment of miscellaneous items such as tape, writing devices, and the like.

Figure 3:
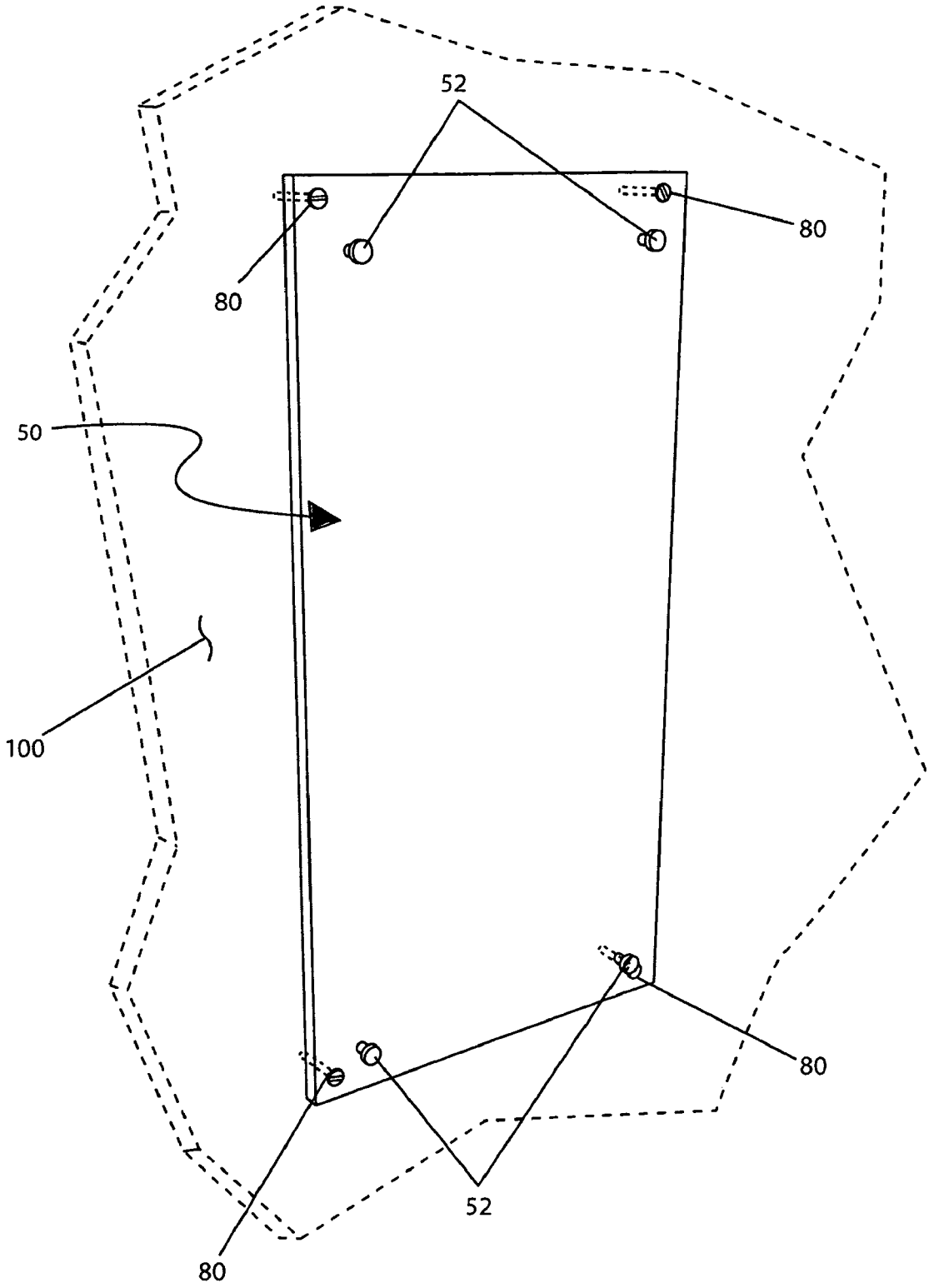
FIG. 3 is a perspective view of the mounting plate portion 50 of a tube container 10, according to a preferred embodiment of the present invention.

Referring now to FIG. 3, a perspective view of the mounting plate portion 50 of the apparatus 10, according to the preferred embodiment of the present invention, is disclosed. The mounting plate 50 provides quick installation and removal of said apparatus 10 thereto a vertical wall surface 100 via four (4) integral and interlocking wall hanging fasteners 52 having corresponding locations and spacing as the aforementioned wall hanging features 29 (see FIG. 2). The mounting plate 50 comprises a rectangular-shaped plate approximately one-quarter (¼) inch thick and having a perimeter shape similar to that of the aforementioned rear panel 26. The wall hanging fasteners 52 provide an interlocking male shape comprising a cylindrical head having suitable dimensions so as to be inserted therein the aforementioned wall hanging features 29. The mounting plate 50 and the wall hanging fasteners 52 are envisioned to be made of rugged plated steel components and are attached to said wall surface 100 using common fasteners 80 such as screws, anchors, bolts, or the like. The mounting plate 50 provides an attachment means thereto the wall hanging fasteners 52 using common joining methods such as a press fit, welding, threads, or the like.

Figure 4:
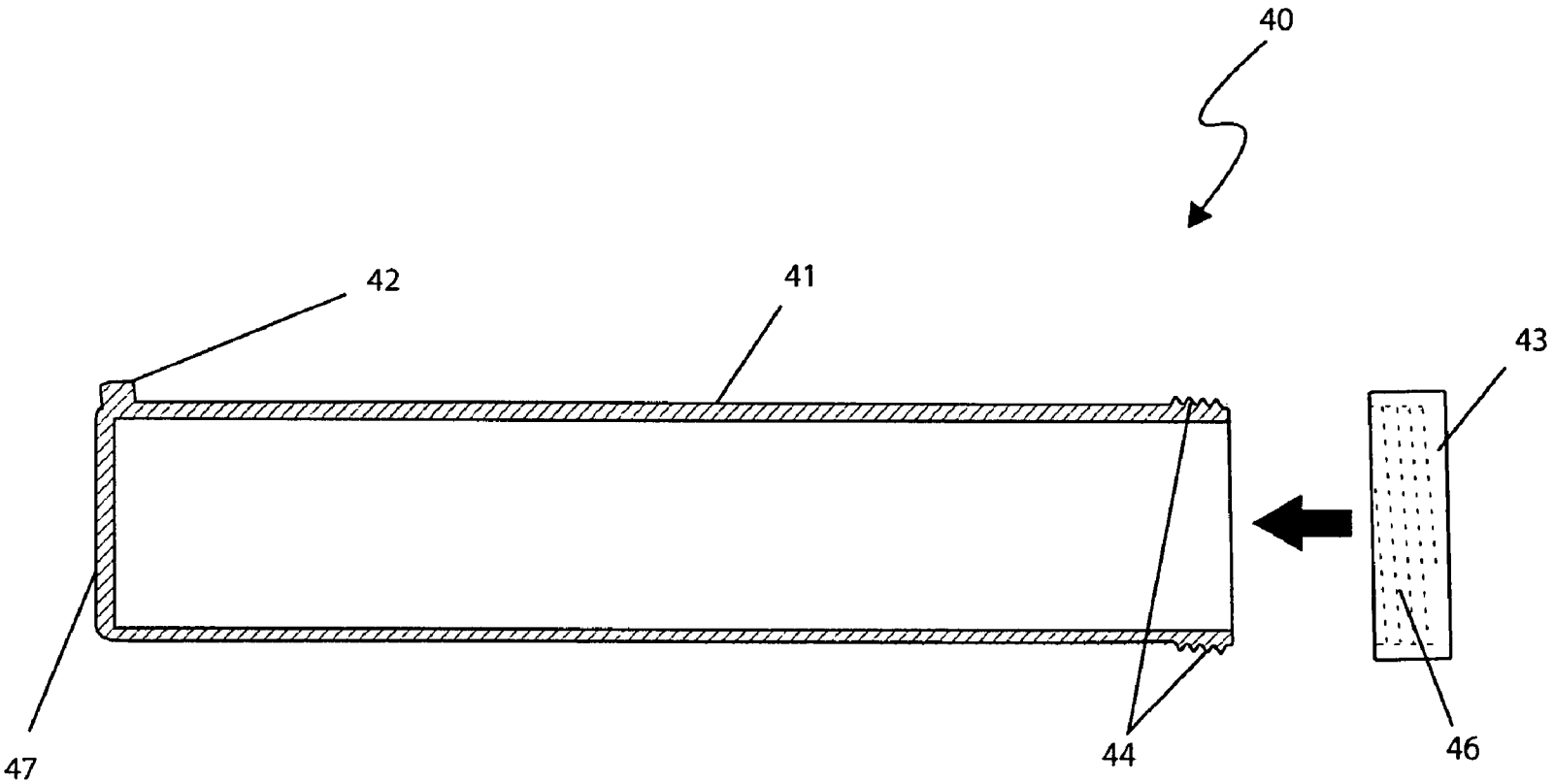
FIG. 4 is a section view along section line B-B of a tube assembly portion 40 of the tube container 10, according to a preferred embodiment of the present invention.

Referring now to FIG. 4, a section view of a tube assembly portion 40 of the tube container 10, according to a preferred embodiment of the present invention, is disclosed. Each tubular container 40 comprises a tube body 41, a tube key portion 42, a tube lid 43, a male thread region 44, and a female threaded region 46. The tubular container 40 comprises a transparent plastic cylindrical vessel providing a storage means for small objects such as fasteners, craft supplies, fishing accessories, and the like. The tube body 41 comprises a clear tubular form further comprising a distal and a proximal end. The distal end of the tube body 41 is close ended by a circular end portion 47 being affixed thereto side portions of the tube body 41 at a right angle using the previously described plastic joining processes. Adjacent thereto the end portion 47, along an outer surface of said tubular container 40, is the tube key portion 42 which provides an orientation means thereto the tubular container 40 when inserted therein the enclosure portion 20 of the apparatus 10. The tube key portion 42 comprises a protruding feature therein said tube body 41 and comprising a rectangular shape approximately one-quarter (¼) of an inch long having particular width and height dimensions to allow smooth insertion thereinto the aforementioned receptacle keys 32 (see FIG. 1). The tube key portion 42 is envisioned to be a molded portion of the tube body 41 or may be affixed thereto using adhesives. The proximal end of the container 30 provides a molded male thread region 44 therearound a perimeter edge, thereby providing a secure threaded attachment thereto the screw-on tube lid 43. The male thread region portion 44 of the tubular container 40 is envisioned to comprise an outer diameter which is slightly greater than that of the receptacle 30 so as to limit insertion of the tubular container 40 thereat an opening of the receptacle 30. The tube lid 43 comprises a common cylindrical lid having an internal female threaded region 46 in an expected manner. The tube lid 43 is envisioned to be made of similar transparent plastic material as the tube body 41 providing easy viewing of contents. The tubular container 40 may be provided in a variety of lengths ranging from approximately eight (8) to sixteen (16) inches long based upon different types of items being stored therewithin.

Figure 5:
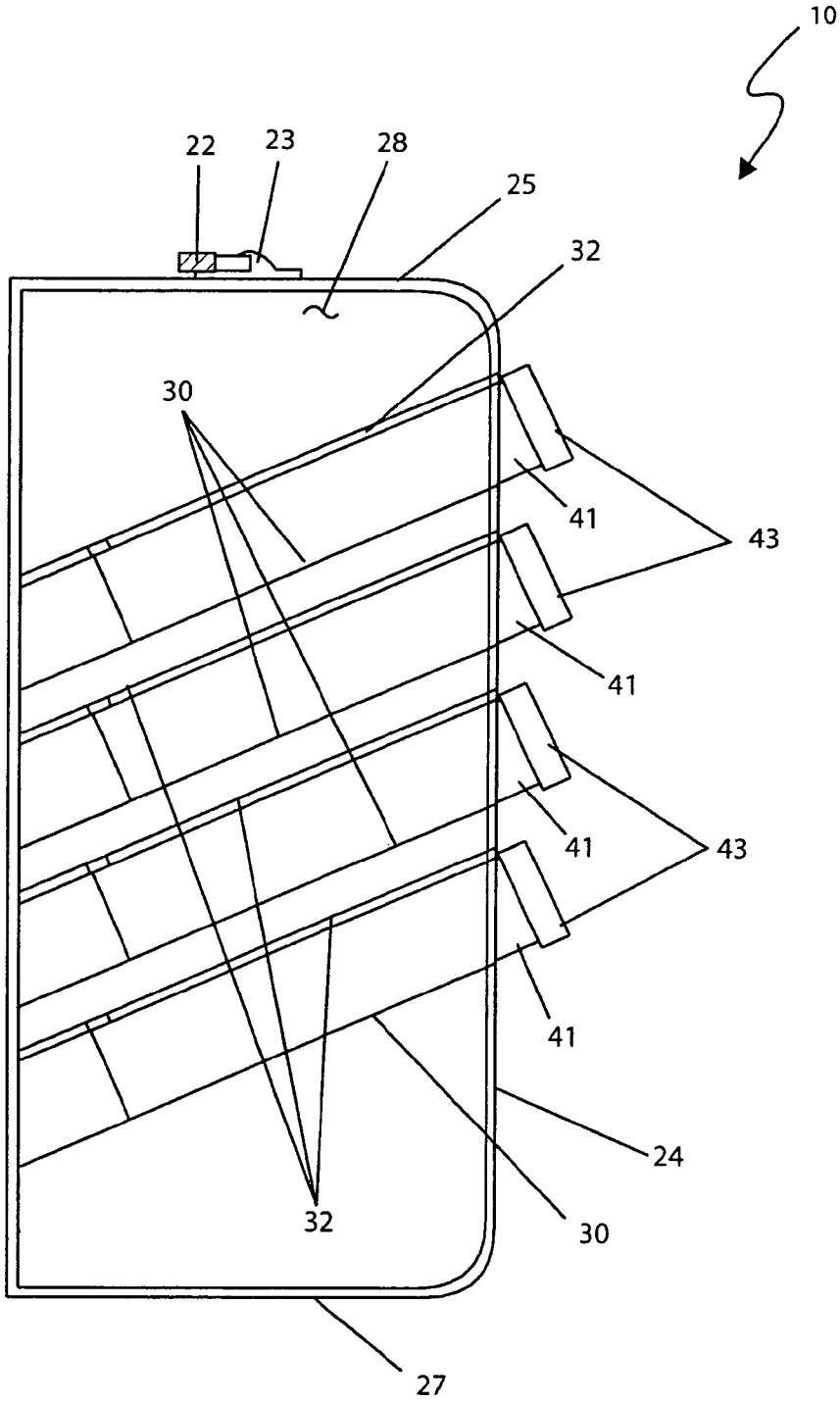
FIG. 5 is a section view along section line A-A of the tube container 10, according to a preferred embodiment of the present invention; and, FIG. 6 is a side view of the tube container 10 showing a mounted configuration thereto a wall surface 100, according to a preferred embodiment of the present invention.

Referring now to FIG. 5, a section view along section line A-A of the tube container 10, according to a preferred embodiment of the present invention, is disclosed. The apparatus 10 is illustrated here depicting an angular orientation of the receptacles 30 and included tubular containers 20 therewithin the enclosure 20.

Figure 6:
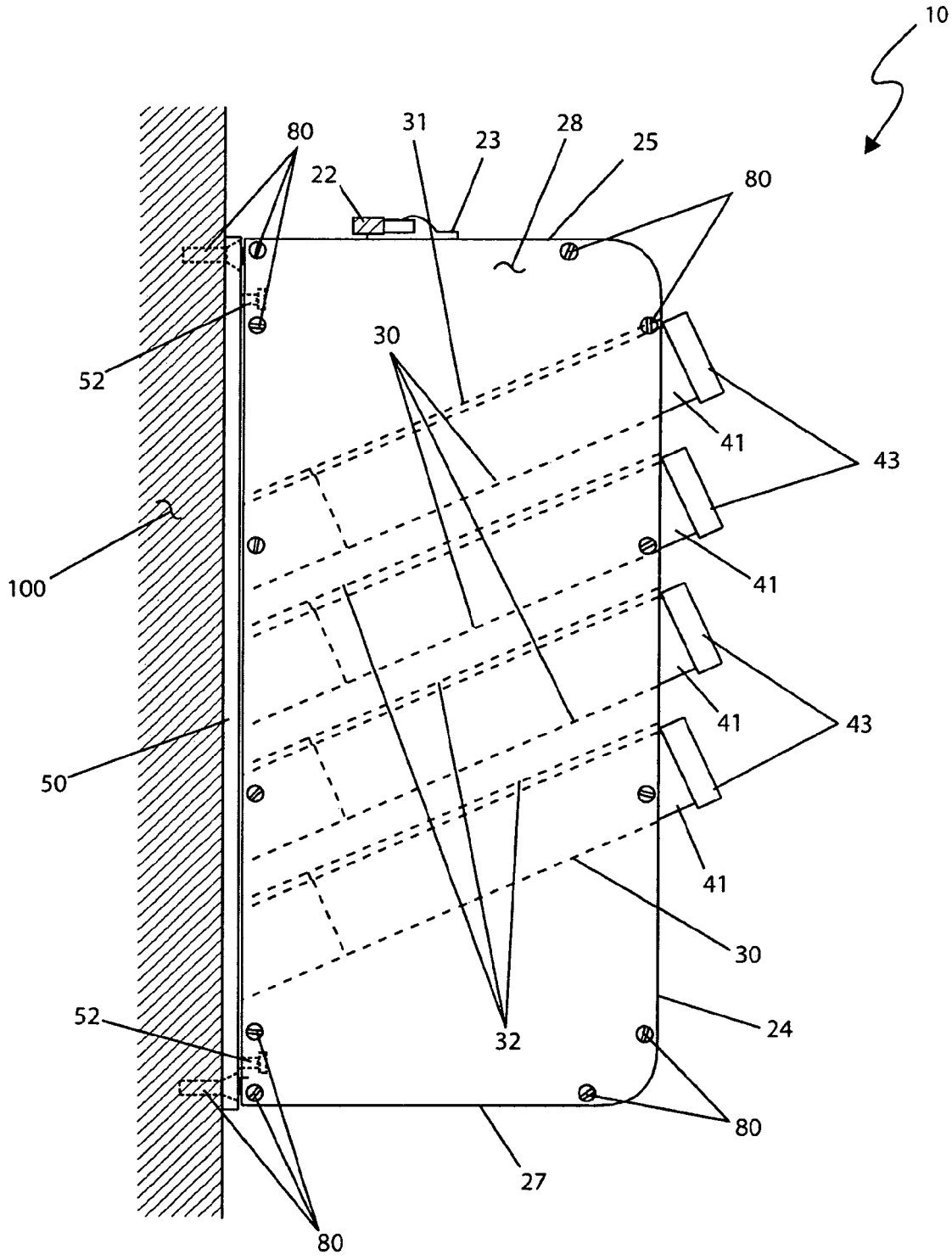

Referring now to FIG. 6, a side view of the tube container 10 showing a mounted configuration thereto a wall surface 100 according to a preferred embodiment of the present invention, is herein described. The apparatus 10 provides removable attachment thereto a wall surface 100 via the mounting plate 50 as shown here.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed and utilized as indicated in FIG. 1.

The method of installing and utilizing the apparatus 10 may be achieved by performing the following steps: permanently securing the mounting plate 50 thereto a desired wall surface area 100 using the provided fasteners 80; attaching the enclosure 20 thereto the mounting plate 50 by inserting the wall hanging fasteners 52 thereinto the wall hanging features 29 and sliding said enclosure 20 downward; inserting the tubular containers 40 thereinto the corresponding receptacles 30 by aligning and inserting the tube key portions 42 thereinto the receptacle keys 32; placing a pair of scissors 110 or similar item thereinto the first fixture 36; placing additional items such as tape, writing utensils, or the like thereinto the second fixture 37; loading a single tubular container 40 by threadingly removing the tube lid 43 and placing various objects therewithin to be stored such as fasteners, craft supplies, fishing accessories, and the like; securing the tube lid 43 thereto the loaded tubular container 40; sliding the container 40 into a receptacle 30 thereinto a desired position along the front panel 24; applying a label 34 thereto the enclosure 20 adjacent thereto the tubular container 40 or directly thereupon the tube lid 43; writing appropriate identifying script thereupon said label 34, thereby indicating said contents therewithin; repeating a loading of additional tubular containers 40 as described above, as needed; removing the apparatus 10 therefrom the mounting plate 50; placing the apparatus 10 on a workbench surface or transporting said apparatus 10 in a portable manner thereto a job site or other remote location using the handle 22, as desired; and, benefiting from compact storage of various miscellaneous items and time saved finding said items using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A storage organizer comprising:

an enclosure, comprising a pair of opposing side panels, a rear panel, and a frame comprising a front panel, a upper panel, a bottom panel, a handle affixed to a pair of handle fasteners at a central location of an outer surface of said upper panel, a set of hanging features each located adjacent to each corner portion of said rear panel, and a mounting plate comprising a set of corresponding hanging fasteners on an enclosure side to said set of hanging features;

a plurality of container receptacles framed thereby said frame comprising a rear end and an open front end; and, a plurality of containers comprising a distal end portion and an open proximal end portion;

wherein said pair of handle fasteners provides a pivoting motion of said handle to a normal vertical carrying position and a flat stored position;

wherein said mounting plate is removably attached to said enclosure;

wherein said set of hanging features each provide a sliding and locking shape so as to receive each of a set of hanging fasteners;

wherein said mounting plate is adaptable to be securely and stably mounted to a vertical surface;

wherein each of said plurality of containers are slidingly engaged therein each of a plurality of container receptacles for easy access;

wherein said plurality of containers are minimally extended therefrom said front panel when fully inserted therein said plurality of container receptacles; and, wherein said organizer provides a means for storing items therein said plurality of containers.

2. The storage organizer of claim 1, wherein said enclosure comprises a durable and lightweight construction preferably using an assembly of molded opaque plastic panels and assembled using a plurality of common fasteners.

3. The storage organizer of claim 1, wherein said enclosure comprises a unitary molded construction.

4. The storage organizer of claim 1, wherein said enclosure comprises a generally rectangular structure approximately two (2) feet tall, one (1) foot deep, and one (1) foot wide and having an upper rounded transition therebetween said front panel and said upper panel and a lower rounded transition therebetween said front panel and said lower panel.

5. The storage organizer of claim 1, wherein said mounting plate comprises a rectangular-shaped plate having a perimeter shape similar to that of said rear panel.

6. The storage organizer of claim 1, wherein further comprising:

a first fixture comprising a "U"-shaped form with an open top and an open bottom, comprising opposing flanges with a set of first fixture hanging fasteners;

a second fixture comprising a four-sided box-like enclosure with an open top, comprising opposing flanges each with a set of second fixture hanging fasteners; and, a set of corresponding fixture hanging features thereto each said first and second fixture hanging fasteners located thereon each of said pair of side panels;

wherein said first fixture and said second fixture are each removably attached thereto each of said opposing side panels;

wherein said first fixture and said second fixture each provide an auxiliary storage means; and, wherein said set of fixture hanging features each provide a sliding and locking shape so as to receive each of a set of first and second hanging fasteners.

7. The storage organizer of claim 1, wherein said plurality of container receptacles each comprise:

a cylindrical receiver affixed thereto an inner surface of said rear panel at said rear end and extending and affixed thereto said front panel at said open front end; and, a receptacle key feature along a top surface and extending an entire length thereof said receiver;

wherein said receptacle key provides an orientation means thereto each of said plurality of containers when inserted therein.

8. The storage organizer of claim 7, wherein each of said plurality of container receptacles each comprise a downwardly sloping angle from said open front end to said rear end to provide convenient insertion and removal thereof said plurality of containers.

9. The storage organizer of claim 8, wherein said downwardly sloping angle is between thirty degrees (30°) and forty-five degrees (45°).

10. The storage organizer of claim 7, wherein said plurality of containers each further comprise:

a cylindrical vessel having a diameter thereby providing a smooth sliding-fit into said cylindrical receiver;

a container key feature corresponding thereto said receptacle key comprising a protruding feature adjacent thereto said distal end portion; and, a lid removably attachable thereto said cylindrical vessel, thereby providing a closure means thereto said open proximal end portion;

wherein said lid comprises an outer diameter slightly larger than said cylindrical receiver to limit said lid from insertion therein said cylindrical receiver;

wherein said container key feature provides an orientation means thereto said tubular container when inserted therein said cylindrical vessel; and, wherein said cylindrical vessel provides said means for storing items therein.

11. The storage organizer of claim 10, wherein said lid comprises an internal female threaded region threadably receiving a male threaded region located thereat said open proximal end;

wherein said male threaded region comprises an outer diameter which is slightly larger than said cylindrical receiver to limit said male threaded region from insertion therein said cylindrical receiver.

12. The storage organizer of claim 11, wherein said cylindrical vessel and said lid each comprises a transparent material to aid in viewing contents therewithin.

13. The storage organizer of claim 10, further comprising a plurality of labels wherein each of said plurality of labels provides an identification means thereto said items stored within each corresponding said cylindrical vessel.

14. The storage organizer of claim 13, wherein each of said labels is applied thereon said front panel adjacent thereto each of said cylindrical receiver.

15. The storage organizer of claim 13, further comprising twelve (12) container receptacles and twelve (12) corresponding containers.

16. A storage organizer comprising:

an enclosure, comprising:

a first side panel, comprising a set of first fixture hanging features thereon an outer surface thereof;

a second side panel opposite said first side panel comprising a set of second fixture hanging features thereon an outer surface thereof;

a rear panel comprising a set of hanging features each located adjacent thereto each corner portion of said rear panel;

a frame comprising a front panel, a upper panel, and a bottom panel further comprising an upper rounded transition therebetween said front panel and said upper panel and a lower rounded transition therebetween said front panel and said lower panel; and, a handle affixed thereto a pair of handle fasteners at a central location of an outer surface thereof said upper panel;

a mounting plate comprising a set of corresponding hanging fasteners on an enclosure side thereto said set of hanging features and a set of mounting attachment means located on a mounting side;

a plurality of container receptacles framed thereby said frame comprising a rear end and an open front end, further comprising:

a downwardly sloping angle from said open front end to said rear end to provide convenient insertion and removal thereof said plurality of containers;

a cylindrical receiver affixed thereto an inner surface of said rear panel at said rear end and extending and affixed thereto said front panel at said open front end; and, a receptacle key feature along a top surface and extending an entire length thereof said receiver;

a plurality of containers comprising a distal end portion and an open proximal end portion, further comprising:

a transparent cylindrical vessel having a diameter thereby providing a smooth sliding-fit into said cylindrical receiver;

a male threaded region located thereat said open proximal end;

a container key feature corresponding thereto said receptacle key comprising a protruding feature adjacent thereto said distal end portion; and, a transparent lid removably attachable thereto said cylindrical vessel, thereby providing a closure means thereto said open proximal end portion an comprising an internal female threaded region threadably receiving said male threaded region;

a first fixture comprising a "U"-shaped form with an open top and an open bottom, comprising opposing flanges with a set of first fixture hanging fasteners;

a second fixture comprising a four-sided box-like enclosure with an open top, comprising opposing flanges each with a set of second fixture hanging fasteners; and, a plurality of labels each attached adjacent thereto a corresponding cylindrical receiver;

wherein said pair of handle fasteners provides a pivoting motion of said handle thereto a normal vertical carrying position and a flat stored position;

wherein said mounting plate is removably attached thereto said enclosure;

wherein said set of hanging features each provide a sliding and locking shape so as to receive each of a set of hanging fasteners;

wherein said set of mounting attachment means provides a secure and stable means therefor said mounting means thereto said vertical surface;

wherein said first fixture and said second fixture are each removably attached thereto each of said opposing side panels;

wherein said first fixture and said second fixture each provide an auxiliary storage means;

wherein said set of fixture hanging features each provide a sliding and locking shape so as to receive each of a set of first and second hanging fasteners;

wherein said receptacle key provides an orientation means thereto each of said plurality of containers when inserted therein;

wherein said male threaded region comprises an outer diameter which is slightly larger than said cylindrical receiver to limit said male threaded region from insertion therein said cylindrical receiver;

wherein each of said plurality of containers are slidingly engaged therein each of a plurality of container receptacles for easy access;

wherein each of said plurality of labels provides an identification means thereto said items stored within each corresponding said cylindrical vessel; and, wherein said organizer provides a means for storing items therein said plurality of containers.

17. The storage organizer of claim 16, wherein said enclosure comprises a unitary molded construction.

18. The storage organizer of claim 17, further comprising:

said enclosure comprises a generally rectangular structure approximately two (2) feet tall, one (1) foot deep, and one (1) foot wide and having an upper rounded transition therebetween said front panel and said upper panel and a lower rounded transition therebetween said front panel and said lower panel;

said cylindrical vessel comprises a length of approximately eight (8) to sixteen (16) inches and a diameter of approximately two (2) to three (3) inches;

said downwardly sloping angle is between thirty degrees (30°) and forty-five degrees) (45°).

* * * * *